US012338635B2

(12) United States Patent
Boo

(10) Patent No.: US 12,338,635 B2
(45) Date of Patent: Jun. 24, 2025

(54) BUILDING PANEL WITH MECHANICAL LOCKING DEVICE

(71) Applicant: Välinge Innovation AB, Viken (SE)

(72) Inventor: Christian Boo, Kågeröd (SE)

(73) Assignee: VÄLINGE INNOVATION AB, Viken (SE)

( * ) Notice: Subject to any disclaimer, the term of this patent is extended or adjusted under 35 U.S.C. 154(b) by 241 days.

(21) Appl. No.: 17/842,122

(22) Filed: Jun. 16, 2022

(65) Prior Publication Data

US 2022/0403664 A1 Dec. 22, 2022

(30) Foreign Application Priority Data

Jun. 18, 2021 (SE) ..... 2150785-0

(51) Int. Cl.
*E04F 13/08* (2006.01)
*E04F 15/02* (2006.01)

(52) U.S. Cl.
CPC .... *E04F 13/0894* (2013.01); *E04F 15/02038* (2013.01); *E04F 2201/0138* (2013.01);
(Continued)

(58) Field of Classification Search
CPC ..... E04C 2/00; E04C 2002/001; E04F 15/02038; E04F 2201/0146; E04F 2201/0535; E04F 13/10; E04F 15/102; E04F 15/107; E04F 2201/0169; E04F 2201/0547; E04F 2201/0153; E04F 2201/0523; E04F 2201/0115;
(Continued)

(56) References Cited

U.S. PATENT DOCUMENTS 7,584,583 B2 * 9/2009 Bergelin ..... E04C 2/24 52/177
2006/0101769 A1 * 5/2006 Pervan ..... E04F 15/02 52/591.1

(Continued)

FOREIGN PATENT DOCUMENTS

WO 2020/234711 A1 11/2020

OTHER PUBLICATIONS

U.S. Appl. No. 17/716,622, filed Apr. 8, 2022, Anders Nilsson.

(Continued)

*Primary Examiner* — Gisele D Ford
(74) *Attorney, Agent, or Firm* — Boone IP Law

(57) ABSTRACT

A set of building panels, such as floor or wall panels, having a mechanical locking device at opposite first and second edge portions, such as short edges, configured for horizontal locking of similar or essentially identical panels in an assembled position by means of displacement in an engagement direction, such as a vertical direction, of the second edge portion of a second panel relative the first edge portion of an adjacent first panel. The second edge portion has a locking groove configured to receive a locking element of the first edge portion of an adjacent first panel by means of the displacement. An outer portion of the locking element, such as in a horizontal direction transverse the first edge portion, is configured to cooperate with an inner portion of the locking groove for positioning, such as horizontal positioning, respective upper edge portions of the first and second edge portions during assembling.

16 Claims, 7 Drawing Sheets

FIG. 2B

(52) U.S. Cl.
CPC ... *E04F 2201/023* (2013.01); *E04F 2201/042* (2013.01); *E04F 2201/043* (2013.01); *E04F 2201/0535* (2013.01)

(58) Field of Classification Search
CPC ..... E04F 2201/0552; E04F 2201/0176; E04F 2201/044
See application file for complete search history.

(56) References Cited

U.S. PATENT DOCUMENTS

2008/0010937 A1* 1/2008 Pervan ..... E04F 15/02 52/588.1
2011/0131909 A1 6/2011 Hannig
2011/0167750 A1* 7/2011 Pervan ..... E04F 15/02038 52/582.2
2012/0067461 A1 3/2012 Braun
2013/0014463 A1* 1/2013 Pervan ..... E04F 15/107 52/582.2
2013/0042565 A1* 2/2013 Pervan ..... E04F 15/02038 52/588.1
2013/0097959 A1 4/2013 Michel
2015/0000221 A1* 1/2015 Boo ..... E04F 15/02038 52/588.1
2015/0300029 A1* 10/2015 Pervan ..... E04F 15/02038 52/582.2
2017/0175400 A1 6/2017 Josefsson et al.
2018/0119429 A1* 5/2018 Schulte ..... E04F 15/02038
2020/0181923 A1* 6/2020 Quist ..... E04F 15/02155
2021/0087827 A1 3/2021 Ylikangas et al.

OTHER PUBLICATIONS

U.S. Appl. No. 17/825,654, filed May 26, 2022, Roger Ylikangas.
U.S. Appl. No. 18/057,811, filed Nov. 22, 2022, Darko Pervan.
U.S. Appl. No. 18/176,003, filed Feb. 28, 2023, Richard William Kell.
U.S. Appl. No. 18/309,118, filed Apr. 28, 2023, Christian Boo.
U.S. Appl. No. 18/223,091, filed Jul. 18, 2023, Roger Ylikangas.
International Search Report and Written Opinion received for PCT Patent Application No. PCT/SE2022/050591, mailed on Sep. 14, 2022, 15 pages.
Office Action received for Swedish Patent Application No. 2150785.0, mailed on Mar. 1, 2022, 8 pages.
U.S. Appl. No. 18/407,549, filed Jan. 9, 2024, Karl Quist.
U.S. Appl. No. 18/631,407, filed Apr. 10, 2024, Darko Pervan.
Extended European Search Report mailed on Apr. 9, 2025 by the European Patent Office in Application No. EP 22825434.8 (10 pages).

* cited by examiner

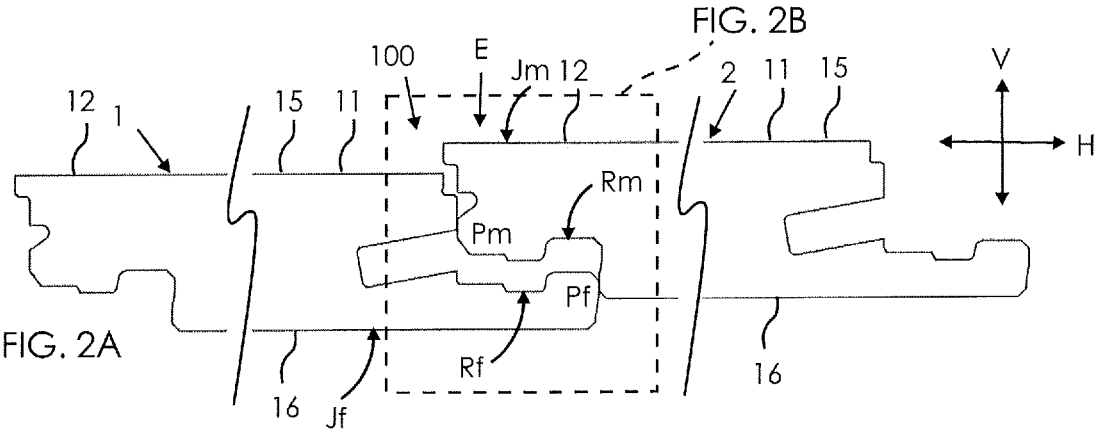
FIG. 2A
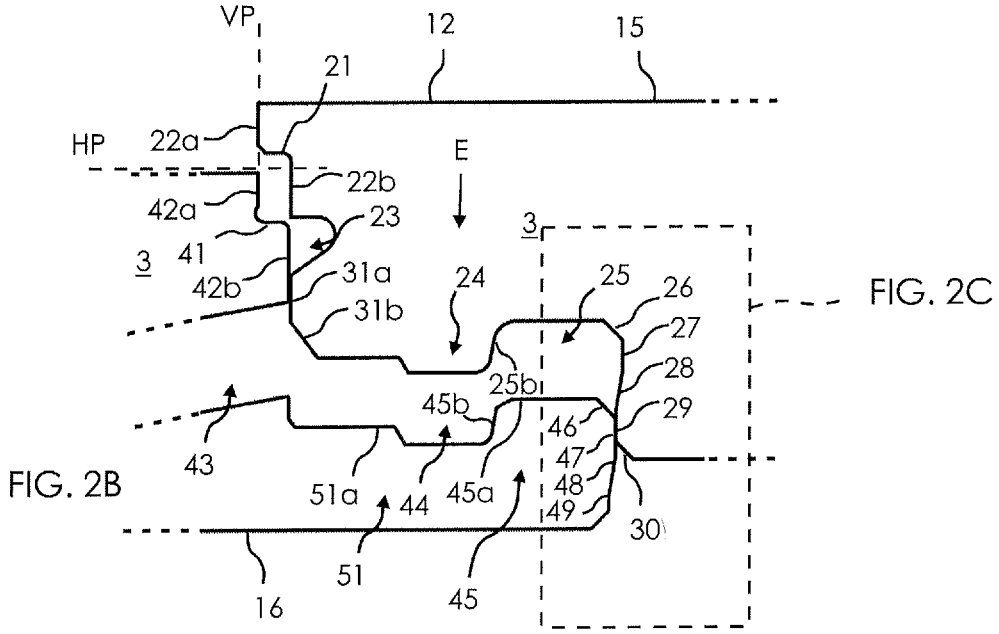
FIG. 2B
FIG. 2C
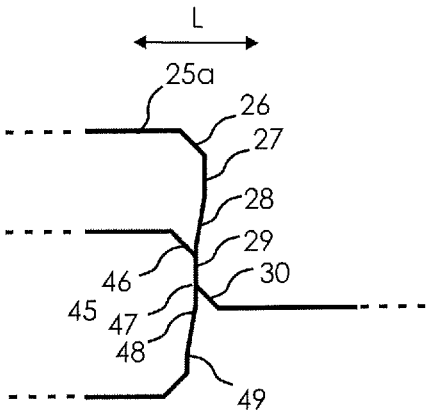
FIG. 2C

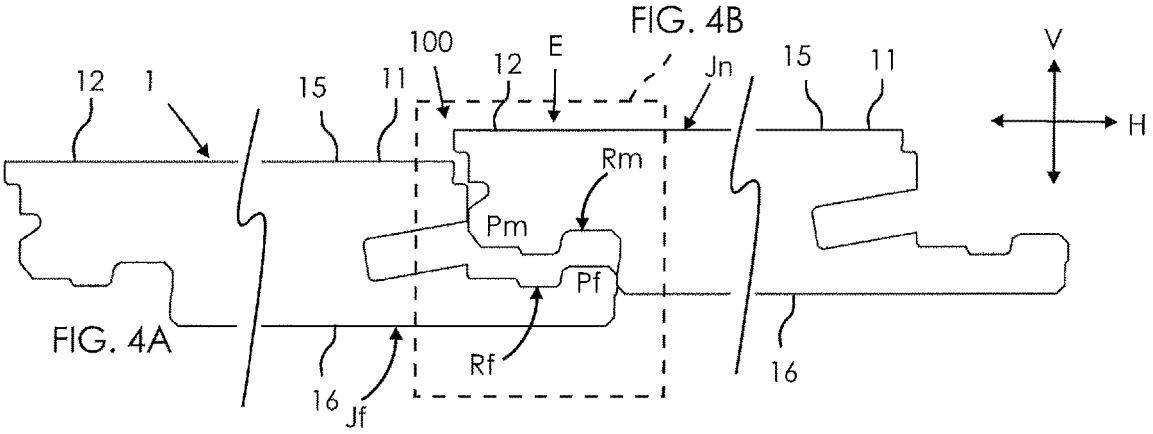
FIG. 4B
100
E
12
Jn
15
11
V
H
12
1
15
11
Rm
Pm
Pf
FIG. 4A
Rf
16
16
Jf
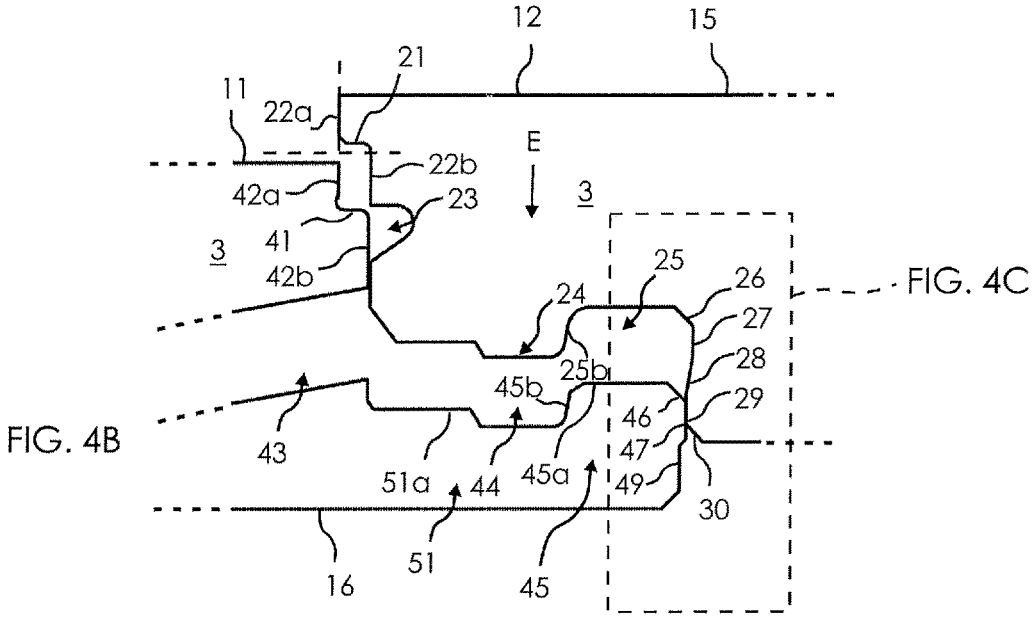
12
15
21
11
22a
E
22b
42a
23
3
3
41
42b
25
26
FIG. 4C
24
27
28
25b
45b
29
46
FIG. 4B
43
47
51a
44
45a
49
30
16
51
45
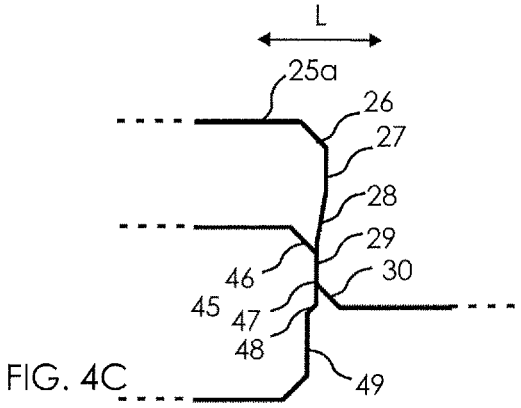
L
25a
26
27
28
29
46
30
45
47
48
FIG. 4C
49

BUILDING PANEL WITH MECHANICAL LOCKING DEVICE

CROSS REFERENCE TO RELATED APPLICATIONS

The present application claims the benefit of Swedish Application No. 2150785-0, filed on Jun. 18, 2021. The entire contents of Swedish Application No. 2150785-0 are hereby incorporated herein by reference in their entirety.

TECHNICAL FIELD

Aspects of the disclosure relates to a set of building panels, such as floor panels or wall panels, with a mechanical locking device for locking of similar or essentially identical panels in an assembled position.

TECHNICAL BACKGROUND

Building panels, such as floor panels or wall panels, may typically have a mechanical locking device for assembling with similar building panels in a locked position. The mechanical locking device may lock the adjacent building panels in a horizontal and/or vertical direction. A known building panel has a first and a second opposite edge portions, such as short or long edges, and a mechanical locking device configured to lock the adjacent edge portions of two adjacent building panels horizontally and vertically. This may be done, e.g., by a vertical displacement of the second edge portion of a building panel towards and into the first edge portion of an adjacent building panel. Further, a known building panel has a third and a fourth opposite edge portions, and a mechanical locking device configured to lock the third edge portion and the fourth edge portion of two adjacent building panels in a horizontal and/or vertical direction. This may be done, e.g., by a folding displacement. The vertical locking of the first and second edge portion may be achieved by various principles. It has been found that for example this type of assembling may inflict damage to some parts of at least one of the panels. Accordingly, there is room for improvement in the technical field.

SUMMARY

An object of the present invention is to provide improvements over known art. This object is achieved by a technique defined in the appended independent claims; certain embodiment being set forth in the related dependent claims.

In a first aspect of the inventive concept there is provided a set of building panels, such as floor panels or wall panels, wherein each building panel includes a front surface and a back surface each extending between a first edge portion and an opposite second edge portion, and between a third edge portion and an opposite fourth edge portion, where the back surface is parallel to the front surface and displaced in a direction perpendicular to the front surface. Each building panel further includes a mechanical locking device arranged at the opposite first and second edge portions, configured for locking, in a direction parallel and/or perpendicular to the front surface, of similar or essentially identical building panels in an assembled position, by displacement in an engagement direction, such as in a direction perpendicular to the front surface, of the second edge portion of a second building panel relative the first edge portion of an adjacent first panel. The mechanical locking device, at said second edge portion, has a locking groove configured to receive a locking element of the mechanical locking device arranged at said first edge portion of the adjacent first building panel, by said displacement. An outer portion of said locking element is configured to cooperate with an inner portion of the locking groove for displacing, such as displacing in a direction parallel to the front surface, an upper edge portion of said second edge portion of the second building panel in relation to an upper edge portion of the first edge portion of the adjacent first building panel during the displacement in the engagement direction of the second building panel during the assembling. The upper edge portion of the second edge portions of the second building panel and the upper edge portion of the first edge portion of the adjacent first building panel are configured to cooperate in an assembled position.

Due to the possible displacement of the second building panel, in a direction parallel to the front surface, in relation to the first building panel during the assembling of the two building panels the risk of e.g. damaging the two adjacent edge portions, front surfaces or respective mechanical locking device is reduced.

BRIEF DESCRIPTION OF THE DRAWINGS

The disclosure will in the following be described in connection to exemplary embodiments and in greater detail with reference to the appended exemplary drawings, wherein:

FIG. 2A is a schematic cross-sectional view of a first and a second building panel during assembling by means of a vertical displacement, according to an embodiment.

FIG. 2B shows details of the embodiment of FIG. 2A.

FIG. 2C shows further details of the embodiment of FIG. 2A.

FIG. 4A is a schematic cross-sectional view of a first and a second building panel during assembling by means of a vertical displacement, according to an embodiment.

FIG. 4B shows details of the embodiment of FIG. 4A.

FIG. 4C shows further details of the embodiment of FIG. 4A.

DETAILED DESCRIPTION OF EMBODIMENTS

Figure 1A:
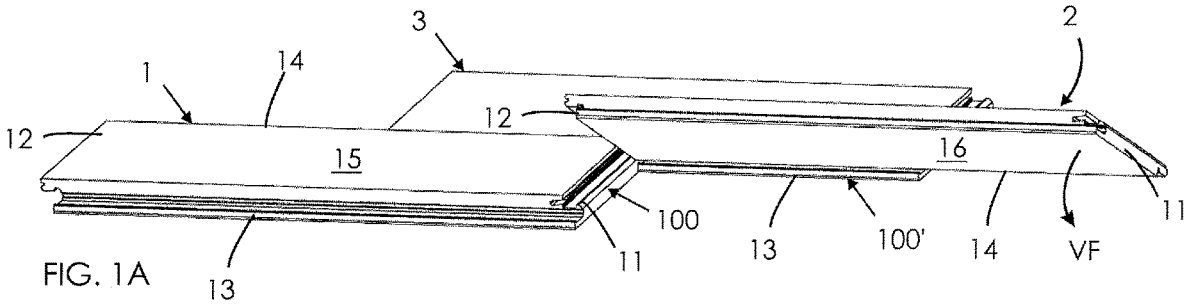
FIG. 1A shows a second building panel being assembled to a first building panel by means of a vertical folding of the second building panel.

Specific embodiments of the invention will now be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the embodiments illustrated in the accompanying drawings is not intended to be limiting of the invention. In the drawings, like numbers refer to like elements.

The horizontal and vertical direction are applicable definition when the building panel is lays flat on e.g. a floor. Instead of horizontal and vertical directions, the description will also refer to a direction parallel with extension of the front and/or back surface and a direction perpendicular to the extension of the front and/or back surface. When a building panel is lays flat on, e.g., a floor, the horizontal direction is the same as the direction parallel with the extension of the front and/or back surface and the vertical direction is the same as the direction perpendicular to the extension of the front and/or back surface.

Figure 1B:
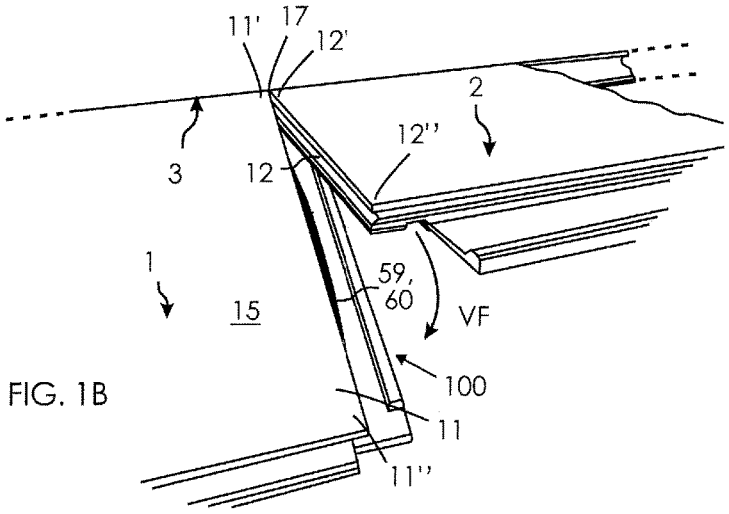
FIG. 1B shows details of the first edge portion of the first building panel and the second edge portion of the second building panel of FIG. 1A.
Figure 1C:
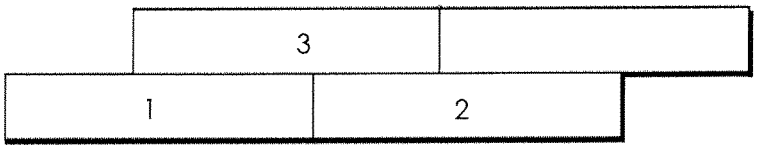
FIG. 1C shows a top view of a set of assembled building panels.

A set of building panels, such as floor panels, wall panels, ceiling panels, furniture elements or similar, is shown in FIGS. 1A-C. Each building panel 1, 2, 3 includes four side edges, the first edge portion 11, the second edge portion 12, the third edge portion 13 and the fourth edge portion 14. The first edge portion 11 is arranged opposite the second edge portion 12 and the third edge portion 13 is arranged opposite the fourth edge portion 14.

Each building panel 1, 2, 3 further includes a front surface 15 and a back surface 16. The front surface 15 and the back surface 16 each extends between the first edge 11 and the opposite second edge 12, and between the third edge 13 and the opposite fourth edge 14. The back surface 16 is parallel to the front surface 15 and displaced in a direction perpendicular to the front surface 15.

Each building panel 1, 2, 3 includes at least one type of a mechanical locking device 100, 100' configured to lock similar or essentially identical building panels 1, 2, 3 in an assembled position. Such a mechanical locking device 100, 100' is configured to lock said building panels 1, 2, 3 in a vertical and/or horizontal direction, which also can be referred to as directions perpendicular and/or parallel to the front or back surface 15, 16. In the illustrated embodiments a building panel 1, 2, 3 is provided with two types of mechanical locking devices, a first mechanical locking device 100, arranged along the first and second edge portion 11, 12 of the building panel 1, 2, 3, and a second mechanical locking device 100', arranged along the third and fourth edge portion 13, 14 of the building panel 1, 2, 3. Embodiments of a first mechanical locking device 100 are illustrated in FIGS. 2A-10B.

As illustrated in FIGS. 2A-10B a first mechanical locking device 100 is provided at opposite first and second edge portions 11, 12, which preferably are short edges of building panels 1, 2, 3 having a rectangular shape. The mechanical locking device 100 is configured for at least horizontal H locking, or locking in a direction parallel to the front surface 15, preferably also vertical locking, or locking in a direction perpendicular to the front surface 15, of similar or essentially identical panels in an assembled position by means of displacement in an engagement direction E, such as a vertical V direction. As derivable from FIGS. 1A and 1B, the second edge portion 12 of the second building panel 2 is assembled to the first edge portion 11 of the first building panel 1 simultaneously as the fourth edge portion 14 of the second building panel 2 is assembled to the third edge portion 13 of an adjacent third building panel 3 by means of a folding displacement, in this case a folding displacement F of the second panel 2 about the fourth edge portion 14. Thereby, the second edge portion 12 of the second panel 2 is displaced vertically in relation to the first edge portion 11 of the first panel 1. Such an assembling of the first and second edge portions 11, 12 may be referred to as vertical folding, implying that an engagement direction E is vertical as a consequence of folding of the second panel 2.

The first and second edge portions 11, 12 are provided with a mechanical locking device 100 configured to lock the adjacent edge portions 11, 12 horizontally and vertically by means of such vertical displacement.

The vertical locking may be achieved by various principles, one of which is schematically illustrated in FIG. 1B. The vertical locking may typically be achieved by a locking tongue 60 configured to cooperate with a wedge groove 23. In the exemplary embodiment shown in FIG. 1B, the locking tongue 60 is a displaceable locking tongue configured to be displaced in a displacement groove 43 shown for example in FIG. 2B and FIG. 4B. The locking tongue 60 is configured to cooperate with the wedge groove 23 for vertical locking of the adjacent panels 1, 2 in a plane.

Figure 8:
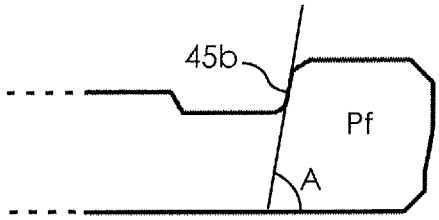
FIG. 8 shows a locking angle of a horizontal locking surface, according to an embodiment.

FIGS. 2A-2C and FIGS. 3A-3C show a first embodiment of the disclosure, FIGS. 4A-4C and FIGS. 5A-5C show a second embodiment of the disclosure and FIG. 8 shows a further embodiment of the disclosure. Although reference herein will mostly be made to the first embodiment, it should be appreciated that the second embodiment generally comprises the corresponding features of the first embodiment, unless the contrary is specifically mentioned.

Referring to FIGS. 2A-3C, the second edge portion 12 may herein be referred to as a male joint Jm and the first edge portion 11 may be referred to as a female joint Jf, where the male joint Jm and the female joint Jf each are configured to be compatible with each other in an assembled position between two adjacent building panel 1, 2, 3.

The male joint Jm of the second edge portion 12 further comprises a downward open male recess Rm comprising a locking groove 25 configured to receive a female protrusion Pf comprising a locking element 45 of the female joint Jf of the first edge portion 11 of the adjacent first panel 1 by means of the displacement of the second panel 2 in the engagement direction E. An outer portion of the female protrusion Pf is configured to cooperate with an inner portion of the locking groove 25 of the male recess Rm, such as in a horizontal direction H transverse the first edge portion 11, during the assembling for relative positioning of, such as in a horizontal direction, an upper edge surfaces/portions 22*a* of the second edge portion 12 and an upper edge surface/portion 42*a* of the first edge portions 11. The cooperation between the outer portion of the female protrusion Pf and the inner portion of the locking groove 25 of the male recess Rm during the assembling of the adjacent building panels may also be for relative positioning, such as in a horizontal direction, of a lower edge surface/portion 22*b* of the second edge portion 12 and a lower edge surface/portion

42*b* of the first edge portion 11. The upper edge surface/portion 22*a* of the second edge portion 12 and the upper edge surface/portion 42*a* of the first edge portion 11 respective the lower edge surface/portion 22*b* of the second edge portion 12 and the lower edge surface/portion 42*b* of the first edge portion 11 are each configured to cooperate with and located opposite each other in the assembled position.

Should the edge portions 11, 12, in particular respective upper edge surfaces/portions 22*a*, 42*a*, not be adequately positioned horizontally, or in a direction parallel to the front surface 15, relative each other, it may during assembling have the consequence that for example a portion, such as an upper edge portion 22*a* of the second edge portion 12, cuts into or otherwise engages with the first edge portion 11, such as a core 3 of the first panel 1. Whereby, damage may be inflicted on the first edge portion 11 upon the folding displacement of the second panel 2 during the assembling process, and to thereby bend an upper edge portion of the first edge 11 upwards. For example, a portion of the second edge portion 12 may engage with the first edge portion 11 below the front surface 15 and due to the folding displacement of the second panel 2 the front surface 15 and/or a surface layer such as a veneer layer, may be bent upwards, such as in the vicinity of the intersection 17, the T-cross, between the first, second and third building panel 1, 2, 3. For example, the damage, such as being bent upwards, may occur within 3 cm of the T-cross, such as within 1 cm of the T-cross.

Figure 3A:
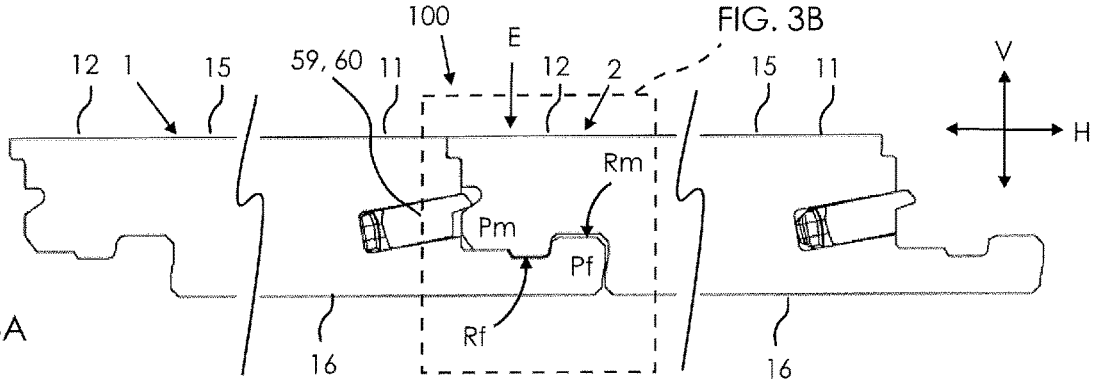
FIG. 3A is a schematic cross-sectional view of a first and a second building panel in an assembled position, according to an embodiment.
Figure 3B:
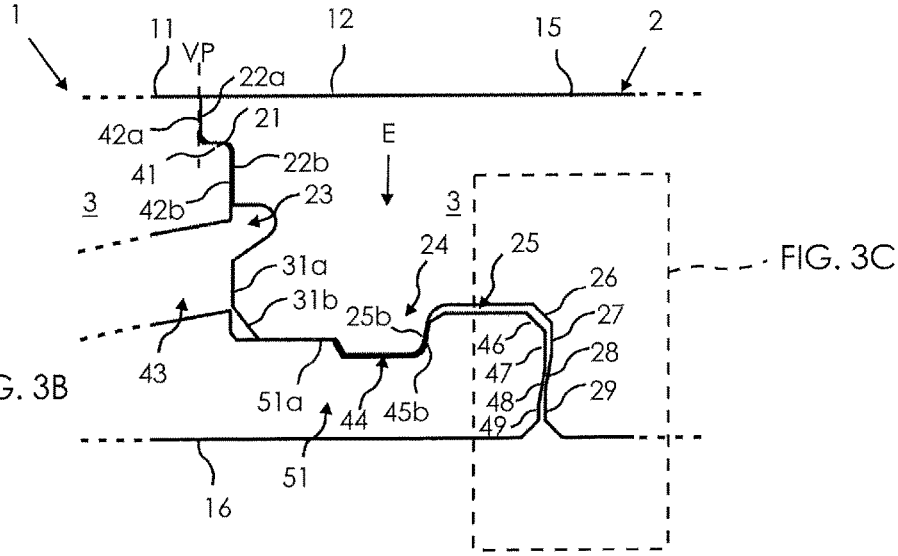
FIG. 3B shows details of the embodiment of FIG. 3A.

In other words, it is preferred that the edge portions 11, 12 of the building panels, which are to be assembled to one another by means of the folding displacement, are arranged in a common vertical plane, VP, the same vertical plane VP which they share in the assembled position, see FIG. 3B, or slightly spaced apart from each other in the lateral direction of the edge portions 11, 12 during the assembling process. It is however not preferred that the second edge portion 12, which is the illustrated example in FIG. 1B, is arranged, in the lateral direction of the edge portion, above the first edge portion 11, i.e. crossed over the common vertical plane, which may occur if the upper edge portion 22*a* of the second edge portion 12 cuts into the first edge portion 11 of the adjacent building panel. This may lead to, as explained above, undesirable damage to especially the front surface and the upper edge portions of the edge portions or even to the mechanical locking devices provided around the edge portions.

In order to avoid such damages, and to avoid that the edge portions 11, 12 end up on the wrong side of the common vertical plane VP during the folding displacement of the assembling process, a displacement back and forth in the lateral direction of the building panel, that is in the direction transverse the extension of the first and second edge portion 11, 12, of the second building panel 2 is achieved my means of the below defined feature of the mechanical locking device 100, 100'.

The assembling process between the first building panel 1 and the second building panel 2 when the first and second building panel 1, 2 is already assembled to the third building panel 3, is now described in more detail. The initial position, i.e. the first position, of the second building panel 2 before starting the folding displacement VF to assembled it to the first building panel 1 is illustrated in FIG. 1B.

In the first position, the third edge portion 13 of the second building panel 2 is connected to the fourth edge portion 14 of the third building panel 2. The second building panel 2 has been pushed towards the first building panel 1, while being connected to the third building panel 3, such that a first end portion 12' of the second edge portion 12 of the second building panel 2 is arranged adjacent, or even in contact with, a first end portion 11' of the first edge portion 11 of the first building panel 1. The first end portion 12' of the second edge portion 12 of the second building panel 2, the first end portion 11' of the first edge portion 11 of the first building panel 1 and partly the fourth edge portion 14 of the third building panel 3 forms an intersection 17 between the three building panels 1, 2, 3. The intersection 17 has a T-shape.

From the first position, as illustrated in FIG. 1B, during the folding displacement VF of the second building panel 2, the second edge portion 12 may continuously be assembled to the first edge portion 11 of the first building panel 1, meaning that a second end portion 12" of the second edge portion 12 may be the final portion of the second building panel 2 to be assembled to the first building panel 1. In order to avoid the risks of damaging the front surface 15 during the assembling process, as described above, the displacement back and forth, in the lateral direction of the building panel, i.e. in the direction transverse the extension of the first and second edge portion 11, 12, of the second building panel 2 is achieved continuously over the extension of the second edge portion 12 of the second building panel 2 as the second edge portion 12 is assembled to the first edge portion 11 of the first building panel 1.

The first and second building panels 1, 2, during the assembling process, is at first laterally L displaced slightly away from each other in order to reduce the risks as explained above, and then, preferably, laterally L displaced slightly towards each other for creating the desired assembling position, e.g., a tight seal between the upper edge portions 22*a*, 42*a*. This displacement will now be described in more detail.

Figure 3C:
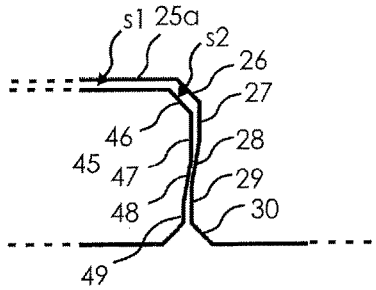
FIG. 3C shows further details of the embodiment of FIG. 3A.
Figure 5A:
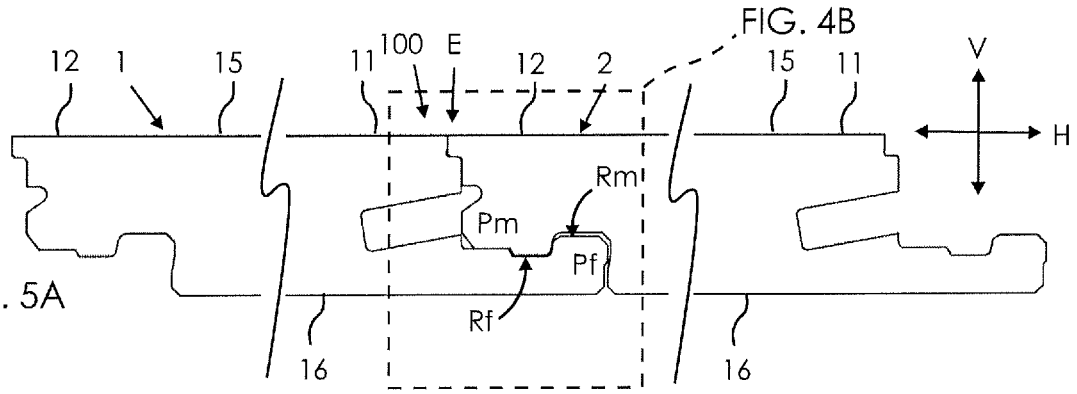
FIG. 5A is a schematic cross-sectional view of a first and a second building panel in an assembled position, according to an embodiment.
Figure 5B:
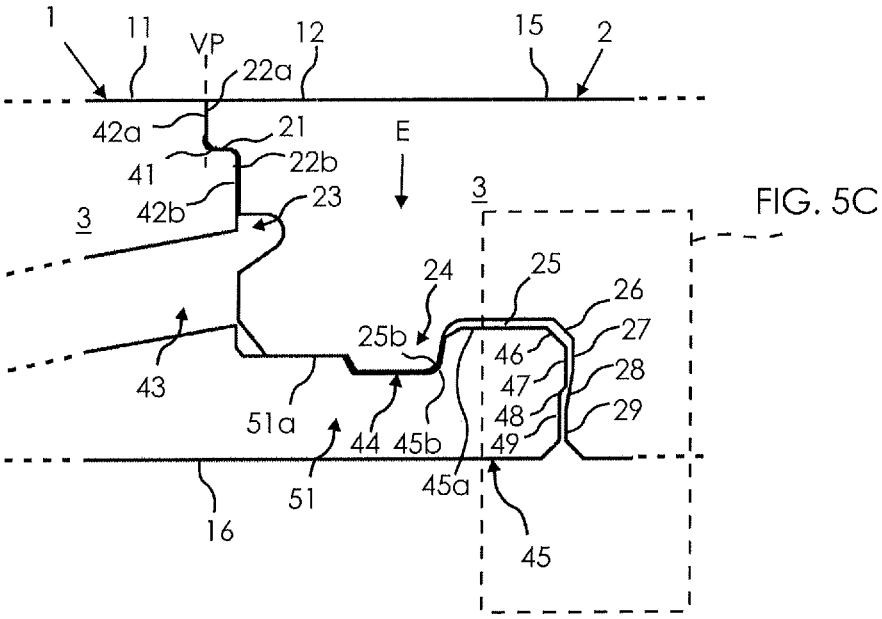
FIG. 5B shows details of the embodiment of FIG. 5A.
Figure 5C:
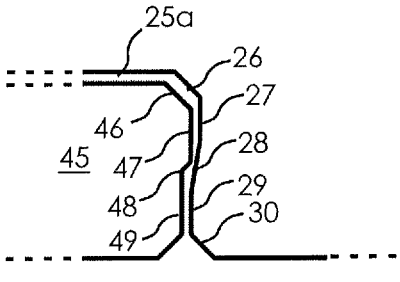
FIG. 5C shows further details of the embodiment of FIG. 5A.

By firstly positioning the edge portions 11, 12 in the direction parallel to the front surface 15, e.g. the horizontal direction, into the first position, the upper edge portions 22*a*, 42*a*, and optionally the lower edge portions 22*b*, 42*b*, of each edge portion 11, 12 are at least partially juxtaposed or at least partially arranged opposing each other, at least in the area of the intersection 17 between the first, second and third building panel 1, 2, 3, as can be seen in FIG. 1B. During the continued assembling process by means of the folding displacement VF, the upper edge portions 22*a*, 42*a* and optionally the lower edge portions 22*b*, 42*b*, are successively arranged juxtaposed or opposite each other throughout the extension of the first and second edge portion 11, 12, until the two adjacent building panels 1, 2 are in the assembled position. Thus, in the assembled position, as illustrated in FIGS. 3A-3C, the upper edge portions 22*a*, 42*a* and optionally the lower edge portions 22*b*, 42*b* are arranged juxtaposed or opposite each other throughout the entire extension of the first and second edge portion 11, 12.

The assembling process, after firstly positioning of the edge portions 11, 12 then proceeds by displacing the second building panel 12 and its second edge portion 12 by means of the folding displacement VF towards the assembled position by being displaced in the engagement direction E, such as a vertical direction, as illustrated in FIGS. 2A-2C. It is now desirable to have a lateral tolerance between the upper edge portions 22*a*, 42*a* and optionally lower edge portions 22*b*, 42*b* respectively. This is for example shown in FIGS. 2B and 3B.

The locking element 45 of the first building panel 1 has at its outer portion, a guiding surface 46, an impact surface 47, which is the outermost part of the locking element 45, and an intermediate surface 48, all described in more detail below. The locking groove 25 of the second building panel 2 which is configured to cooperate with the locking element 45 of the first building panel 1 during the assembling process and in the assembled position, has at its inner portion, a guiding surface 30, an impact surface 29, which is the outermost part of the inner portion of the locking groove 25, an intermediate surface 28 and an inner surface 27.

The first two features to cooperate during the folding displacement VF of the second building panel 2 is the guiding surface 46 of the locking element 45 and the guiding surface 30 of the locking groove 25. They are configured to cooperate with each other during the first contact between the locking element 45 and the locking groove 25 of the assembling process and displace the second building panel 2 away from the first building panel 1. The two guiding surfaces 46, 30 are configured to guide each other into a desired lateral L position, such that the two adjacent building panels 1, 2 are arranged in the desired lateral L position during the displacement in the engagement direction E, where the desired lateral position L is the position where the risk on damaging e.g. the front surface 15 during the folding displacement is reduced.

Further, the impact surface 47 of the locking element 45 and the impact surface 29 of the locking groove are configured to cooperate with each other during the next stage of the assembling process. When the two impact surfaces 47, 29 are cooperating or in contact with each other the two adjacent building panels 1, 2 are at an outermost position, in which the upper edge portions 22*a*, 42*a* are farthest away from each other. From this position, the building panels 1, 2 and their upper edge portions 22*a*, 42*a* are displaced with in the lateral L direction towards each other during the rest of the folding displacement of the second building panel 2 in the engagement direction E. The two impact surfaces 47, 29 may each have a convex and/or protruding shape.

At least some of the outer portions 46-49 of said locking element 45 are configured to engage with, such as sliding along and/or against, at least some of the inner portions 26-30 of the locking groove 25. The term inner may in this context refer to a horizontal direction towards a centre of the building panel.

The impact surface 47, as an outermost portion, of the locking element 45 of the female protrusion Pf and the impact surface 29, as an outermost portion of the inner portion of the locking groove 25 of the male recess Rm are configured such that the lateral displacement of the second edge portion 12 in the engagement direction E is maintained, thus maintaining the lateral L displacement of the upper edge portions 22*a*, 42*a* while arranged on opposite sides of a horizontal plane HP, exemplified and indicated in FIG. 2B; that is, while vertically displaced. For example, an entirety of the upper edge portion 22*a* may be above the horizontal plane HP and an entirety of the upper edge portion 42*a* may be at or below the horizontal plane HP. By further displacing the second building panel 2 in the engagement direction E, which may be an effectively a vertical direction, a portion of the upper edge portion 22*a* of the second edge portion 12 of the second building panel 2 passes the horizontal plane HP. Continued displacement in the engagement direction E causes the upper edge portions 22*a*, 42*b* to not be on opposite sides of the horizontal plane HP. For example, an entirety of the upper edge portion 22*a* of the second edge portion 12 may be at or below the horizontal plane HP and an entirety of the upper edge portion 42*a* of the first edge portion 11 may be at or below the horizontal plane HP. In this position, the upper edge portions 22*a*, 42*a*, and optionally the lower edge portions 22*b*, 42*b*, become juxtaposed, as shown in FIG. 3B.

As described above, during assembling, the second edge portion 12 may be displaced laterally L away from the first edge portion 11 from a second position, where the guiding surfaces 30, 46 meet, to a third position, where the impact surfaces 29, 47 meet, in response to the displacement in the engagement direction E. Such as, the upper edge portions 22*a*, 42*a* of respective edge portions 11, 12 may be in contact or may be laterally spaced within 0.3 mm, such as within 0.2 mm, such as within 0.1 mm. This is advantageous since the risk of, e.g., damaging the edge of the upper surface during the assembling process then may be reduced.

In the third position, the first and second upper edge portions 42*a*, 22*a* are, preferably, not in contact with each other and positioned on opposite sides of the vertical plane VP, or a plane perpendicular to the front surface 15. Optionally, the upper edge portions 22*a*, 42*a* may be positioned on opposite sides of the horizontal plane HP, or a plane parallel the front surface 15. In the third position the two opposite impact surfaces 29, 47 may be aligned. The impact surface 29 of the locking groove 25 is configured to slide against the impact surface 47 of the locking element 45 in a vertical V direction when the second building panel 2 and its edge portion 12 is displaced from the third position to a fourth position.

Thus, the second edge portion 12 may then, due to the folding displacement, be displaced in a substantially vertical direction from the third position to the fourth position, whilst the impact surface 29 of the locking groove 25 is in contact with the impact surface 47 of the locking element 45. In the fourth position, the impact surfaces 29, 47 may have moved past each other, vertically. and the possible contact between the two intermediate surfaces 28, 48 of the locking groove 25 and the locking element 45 may start.

In the fourth position the two impact surfaces 29, 47 may no longer be juxtaposed and/or may no longer be in contact. Thus, the displacement of the second edge portion 12 between the third position and the fourth position may have a major vertical component and a small horizontal component in a direction along the first edge portion 11 in the case of assembling by vertical folding, due to the folding motion of the second building panel 2.

In an embodiment, there may be no displacement of the second edge portion 12 in a horizontal direction transverse the first edge portion 11 during displacement from the third position to the fourth position. Alternatively, as mentioned, the two intermediate surfaces 28, 48 are not brought into contact with each other but the impact surface 28 of the locking groove 25 of the second edge portion 12 of the second building panel 2 is rather displaced from the third position in a vertical direction until the first and second edge portions 11, 12 have reached the assembled position.

FIGS. 3B, 5B, 9 and 10B shows a set of building panels 1, 2, 3 in an assembled position.

The guiding surfaces 46, 30 of the locking element 45 and the locking groove 25 may be configured to cause displacement of the impact surface of the locking groove 25 and thus the second edge portion 12, in a direction towards the impact surface 47 of the locking element 45, such as towards the plane of the impact surface 47 of the locking element 45, in response to displacement of the second edge portion 12 in the engagement direction E, preferably said direction towards the impact surface 47 of the locking element 45 comprises a horizontal H component and a vertical V component.

The two guiding surfaces 46, 30 may be configured such that when the second edge 12 is displaced from the second position to the third position, the guiding surfaces 46, 30 cooperate prior at least a portion of the first and second upper edge portions 42*a*, 22*a* are immediately juxtaposed and/or while first and second upper edge portion 42*a*, 22*a* are positioned on opposite sides of a horizontal H plane. Thereby, during assembling, the guiding surfaces 46, 30 will engage prior to when the upper edge portions 22*a*, 42*a* are overlapping and/or engage.

Preferably, the two impact surfaces 47, 29 are configured such that during assembling, the impact surfaces 47, 29 are at least in contact and may be at least partially juxtaposed while the upper edge portions 22*a*, 42*a* are still not overlapping and/or engage, hence the impact surfaces 47, 29 are at least in contact and may be at least partially juxtaposed prior the upper edge portions 22*a*, 42*a* are overlapping and/or engage. Hence, once in the fourth position the first and second upper edge portion 42*a*, 22*a* may be at least partially positioned on opposite sides of a horizontal H plane.

Additionally, the lower edge portions 42*b*, 22*b* may in the fourth position be positioned at least partially on opposite sides of a horizontal H plane.

Additionally, an upper lip 21, arranged along the second edge portion 12, and a lower lip 41, arranged along the first edge portion 11, may in the fourth position be positioned at least partially on opposite sides of a horizontal H plane.

After the fourth position the second building panel 2 is again allowed to be laterally displaced towards the first building panel 1. Thus, the upper edge portions 22*a*, 42*a* may be brought into contact with each other in the assembled position in order to create the desirable tight seal between the two building panel 1, 2. The lateral displacement L of the second building panel 2 in towards the first building panel 1 is achieved by two locking surfaces 25*b*, 45*b* arranged in the locking groove 25 and on the locking element 45 respectively.

The locking surface 25*b* in the locking groove 25 is arranged on the opposite side of the inner portions 26-30 of the locking groove 25. The locking surface 45*b* of the locking element 45 is arranged on the opposite side of the outer portions 46-49 of the locking element 45.

Once the locking surface 25*b* of the locking groove 25 of the second building panel 2 during the folding displacement VF reaches the locking surface 45*b* of the locking element 45 the locking surface 45*b* the locking element 45 causes the second building panel 2 to be displaced laterally towards the first building panel 1 when it is in contact with the locking surface 25*b* of the locking groove 25. Simultaneously as the locking surface 45*b* of the locking element 45 pushes the second building panel 2 towards the first building panel 1 the outer portions 46-49 of the locking element 45 allows the inner portions 26-30 to follow. I.e. the two opposite impact surfaces 47, 29 are no longer cooperating with or in contact with each other. Instead the impact surface 29 of the locking groove 25 of the second building panel 2 has been displaced down facing an outer surface 49 of the locking element 45 and the impact surface 47 of the locking element 45 facing an inner surface 27 of the locking groove 25. The outer surface 49 and the inner surface 27 allows the second building panel 2 and its impact surfaces 29 to be laterally displaced towards the first building panel 1 as the second building panel 2 moved towards the assembled position, the final position.

In order to facilitate the lateral displacement of the second building panel 2 back towards the first building panel the two locking surfaces 25*b*, 45*b* are sloped. The sloped locking surfaces 25*b*, 45*b* enables a continuous movement when the second building panel 2 is displaced laterally towards the first building panel 1, finally ending up in the assembled position where the upper edge portions 22*a*, 42*a* at respective edge portions 11, 12 are juxtaposed and creating a tight seal between the adjacent building panels 1, 2.

The respective upper edge portions 22*a*, 42*a* of the first and second edge portions 11, 12 may, in the assembled position, be juxtaposed to form a common vertical plane VP as shown for example in FIG. 3B.

The first edge portion 11 further comprises a locking strip 51 projecting beyond the vertical plane VP. The locking strip 51 comprises the locking element 45, as described above, for horizontal locking of the first and second panel 1, 2 in a horizontal H direction, or in a direction parallel to the front surface 15, transverse said edge portions 11, 12.

A female recess Rf and the female protrusion Pf may be formed in the locking strip 51.

The locking strip 51 may comprise a horizontal portion extending between the displacement groove 43, for receiving the locking tongue 60, and the female protrusion Pf.

The guiding surfaces 46, 30 may be configured to cause displacement of a first upper edge portion 22*a* of the second edge portion 12 in a direction into alignment with the plane of the first upper edge portion 42*a* of the first edge portion 11 in response to displacement of the second edge portion 12 in the engagement direction E, such as towards and/or away from the plane of the first upper edge portion 42*a* depending on which side of the plane of the first upper edge portion 42*a* the second upper edge portion 22*a* has as a starting point, for said positioning of the respective upper edge surfaces 22*a*, 42*a*. For example, if an initial horizontal position of the second upper edge portion 22*a* may be inboard of the plane of the first upper edge portion 42*a*, then the guiding surfaces 46, 30 may be configured to cause displacement of a first upper edge portion 22*a* of the second edge portion 12 in a direction towards the plane of the first upper edge portion 42*a*, and into alignment with the plane of the first upper edge portion 42, and optionally to provide a play between respective planes of the upper edge portions 22*a*, 42*a*; a minute displacement away from the plane of the first upper edge portion 42*a*. In a further example, if an initial horizontal position of the second upper edge portion 22*a* may be outboard of the plane of the first upper edge portion 42*a*, then the guiding surfaces 46, 30 may be configured to cause displacement of a first upper edge portion 22*a* of the second edge portion 12 in a direction towards the plane of the first upper edge portion 42*a* and preferably into alignment with the plane of the first upper edge portion 42*a*, or optionally to a position where there is provided a play between the respective planes of the upper edge portions 22*a*, 42*a*.

Figure 6:
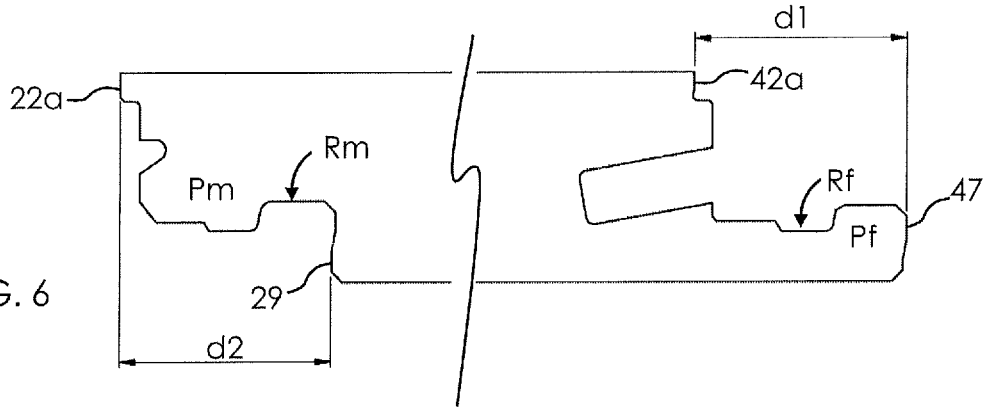
FIG. 6 illustrates certain details of the embodiments of FIGS. 2A-5C.

Referring to FIG. 6, a first distance d1 between the first upper edge portion 42*a* of the first edge 11 and the first impact surface 47 of the first edge 11 may preferably correspond to a second distance d2 between the second upper edge portion 22*a* of the second edge 12 and the second impact surface 29. By configuring the first distance d1 and the second distance d2 to correspond, it is facilitated that during assembling the upper edge portions 22*a* and 42*a* are aligned, preferably prior at least a respective portion of the upper edge portions 22*a* and 42*a* are partially juxtaposed.

The first upper edge portion 42*a* and optionally a first lower edge portion 42*b* may be provided between the locking tongue 59, such as the displaceable locking tongue 60, and the front surface 15. The second upper edge portion 42*a* and optionally a second lower edge portion 42*b* may be provided between the displacement groove 43 and the front surface 15.

The second upper edge portion 22*a* and optionally a second lower edge portion 22*b* may be provided between the wedge groove 23 and the front surface 15.

The first and/or second impact surface 29, 47 may, in the assembled position, extend substantially in a vertical direction, such as parallel the vertical plane (VP).

The first and/or second impact surface 29, 47 may, in the assembled position, be parallel.

Figure 7B:
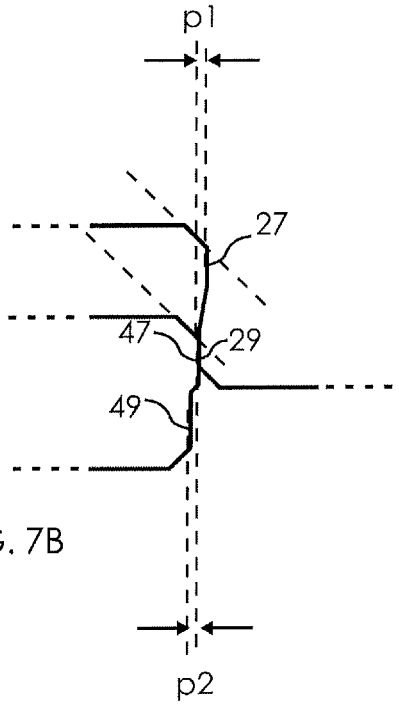
FIGS. 7A-7B show a first play and a second play in assembled position of a set of panels according to an embodiment.
Figure 7A:
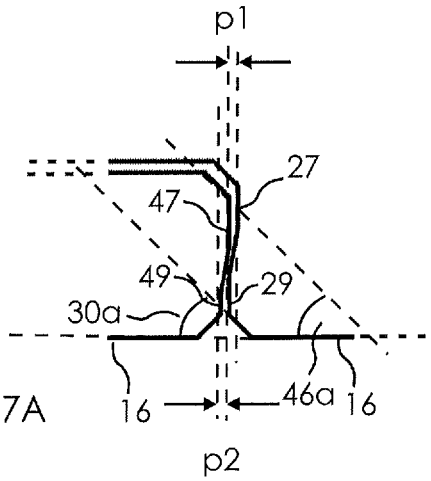
Figure 9:
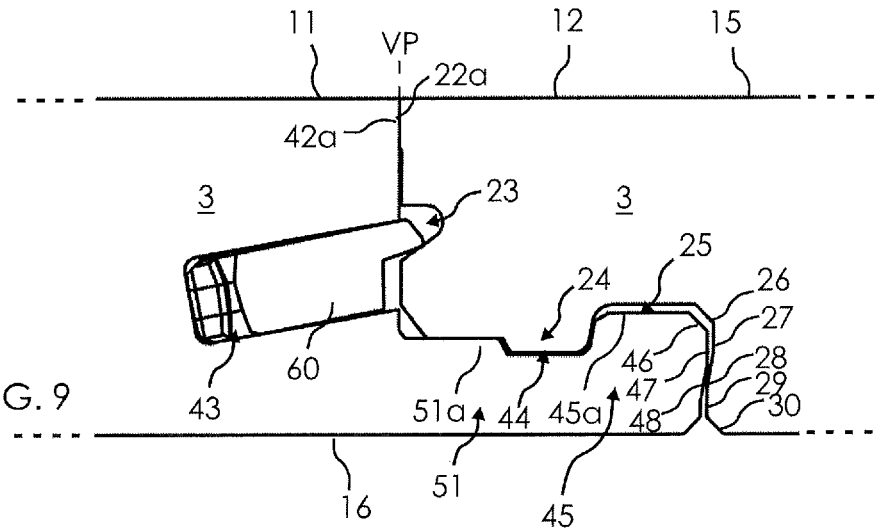
FIG. 9 shows a set of building panels according to a further embodiment.

The first impact surface 47 and the second impact surface 29 may, in the assembled position, be aligned and/or arranged in a common vertical plane as shown in FIG. 7A.

The first impact surface 47 and a first inner surface 27 of the inner portions 26-30, such as an innermost surface, may in the assembled position be horizontally separated by a first play p1 as illustrated in FIG. 7A for the embodiment of FIGS. 2A-3C and in FIG. 7B for the embodiment of FIGS. 4A-5C. The first play p1 may be about 0.5 mm, such as 0.4 mm, such as 0.3 mm, such as 0.2 mm, such as 0.1 mm. The second impact surface 29 and the first outer surface 49 of the outer portions 46-49 are, in the assembled position, horizontally separated by a second play p2 as illustrated in FIG. 7A. The second play p2 may be about 0.5 mm, such as 0.4 mm, such as 0.3 mm, such as 0.2 mm, such as 0.1 mm.

As derivable from FIG. 7A, in the assembled position, according to embodiments the inner portions 26-30 of the male recess Rm and the outer portions 46-49 of the female protrusion Pf do not contribute to vertical locking of the panels. Thus, according to embodiments the outwards protruding convex upper portion of the female protrusion Pf may not overhang the outwards protruding convex lower portion of the male recess Rm in assembled position.

In an embodiment, vertical locking of the panels 1, 2 may be facilitated by configuring the outwards protruding convex upper portion of the female protrusion Pf to overhang the outwards protruding convex lower portion of the male recess Rm in assembled position.

The locking element 45 may comprise an upper surface 45*a*, preferably extending in an essentially horizontal direction. The outer portion 46-49 of the female protrusion Pf, such as in a horizontal direction transverse the first edge portion 11, may comprise an upper protruding portion 46-47 comprising the first guiding surface 46 which may be directly or indirectly contiguous with the upper surface 45*a*.

The first guiding surface 46 may be inclined and/or sloping in a direction towards the plane of the back surface 16 of the panel, preferably the angle 46*a* of the slope is in the range of 40-55 degrees relative the plane of the back surface 16.

The upper protruding portion 46-47 of the female protrusion Pf may further comprise the first impact surface 47 which may be contiguous with the first guiding surface 46, preferably the impact surface 47 extends in a substantially vertical V direction to facilitate assembling by means of a vertical displacement.

Figure 10A:
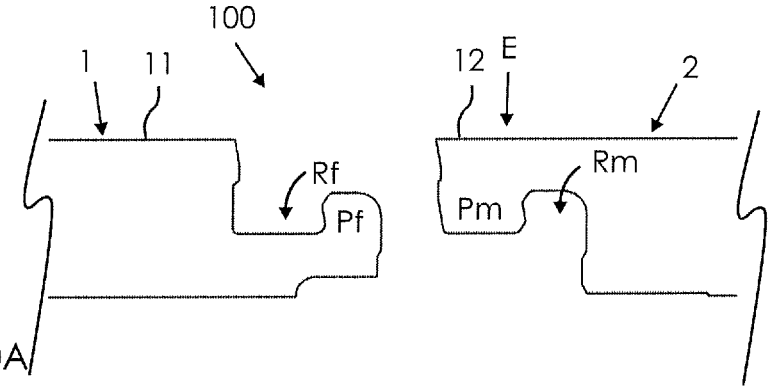
FIG. 10A shows a set of building panels with an integrated locking tongue, according to an embodiment.
Figure 10B:
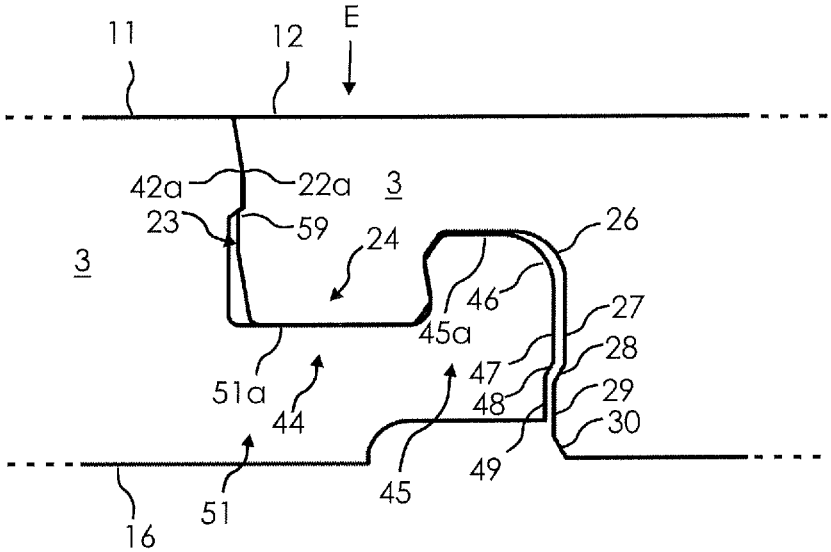
FIG. 10B shows the set of building panels of FIG. 10A in assembled position.

The upper protruding portion 46-47 of the female protrusion Pf may comprise a curved convex shape as shown in FIG. 10B. The upper inwards recessing portion 26-27 of the male recess Rm may comprise an inwards recessing and/or concave shape. Further, in the embodiment of FIGS. 10A-10B, a third locking surface 45*b* may overhang at least a portion of the upper surface 51*a* of the locking strip 51 and overhang the fourth locking surface 25*b* of the male recess Rm to thereby facilitate vertical locking of the panels 1, 2.

The outer portion 46-49 of the female protrusion Pf may comprise an inwards recessing and/or concave lower portion 48-49 comprising a first outer surface 49 which may extend in an essentially vertical direction towards the plane of the back surface 16.

An edge between the first outer surface 49 and the back surface 16 may be chamfered to form a second outer surface 49.

A first intermediate surface 48 may extend between the protruding upper portion 46-47 and the recessing lower portion 49-49 of the outer portion 46-49 of the female protrusion Pf, such as between the first impact surface 47 and the first outer surface 49.

The locking groove 25 of the male recess Rm may comprise an upper surface 25*a*, such as an uppermost surface, which may extend in an essentially horizontal direction. The inner portion 26-30 of the male recess Rm, such as in a horizontal direction transverse the second edge portion 12, may comprise a protruding and/or convex lower portion 29-30 comprising a second guiding surface 30, preferably contiguous with the back surface 16.

The second guiding surface 30 may be inclined in relation to the back surface 16 of the panel, preferably the angle 30*a* of the slope is in the range of 40-55 degrees relative the plane of the back surface 16. The slope of the second guiding surface 30 may correspond to the slope 46*a* of the first guiding surface 46.

The lower portion 29-30 of the inner portion 26-30 of the male recess Rm may further comprise the second impact surface 29 directly or indirectly contiguous with the second guiding surface 30, preferably the second guiding surface 30 extends in a substantially vertical V direction to facilitate assembling my means of a vertical displacement.

The inner portion of the male recess Rm further comprises an inwards recessing and/or concave upper portion 26-27 comprising a first inner surface 27 preferably extending in an essentially vertical direction.

A corner between the first inner surface 27 and the upper surface of the locking groove 25*a* may be chamfered to form a second inner surface 26.

A second intermediate surface 28 may extend between the upper portion 26-27 and the lower portion 29-30 of the inner portion 26-30 of the male recess Rm, such as between the second impact surface 29 and the first inner surface 27.

In the assembled position, the first guiding surface 46 may be arranged opposite the second inner surface 26, i.e. facing the second inner surface 26.

In the assembled position, the first impact surface 47 may be arranged opposite first inner surface 27 of the locking groove. The first inner surface 27 may be an innermost surface of the locking groove 25, in a horizontal direction.

In the assembled position, the first intermediate surface 48 of the locking element 45 may be arranged opposite the second intermediate surface 28 of the locking groove 25.

In the assembled position, the first outer surface 49 of the locking element 45 may be arranged opposite the second impact surface 29 of the locking groove 25.

The locking element 45 may comprise an inner surface 45*a* which may typically be contiguous with an upper surface 51*a* of the locking strip 51. The slope of the inner surface 45*a*, which may be referred to as a locking angle A shown in FIG. 8, may essentially correspond to the slope of the first intermediate surface 48.

As discussed, the locking strip 51 may comprise an upwards open groove 44 configured to receive a downwards extending protrusion 24 of the second edge 12 of an adjacent panel 2.

The mechanical locking device may comprise at one of the first or second edge portion 11, 12 a locking tongue 59, such as a displaceable locking tongue 60, configured to cooperate with a wedge groove 23 of the other of the first or second edge portion 11, 12 for vertical locking of the first and second edge portions in a plane by means of a vertical displacement, such as vertical folding VF.

In any embodiment, the panel may comprise a lower lip portion 41 at the first edge portion 11 and an upper lip portion 21 at the second edge portion 12. The lip portions may respectively comprise a planar and preferably substantially horizontal surface. The upper lip portion 21 may preferably configured to bear on the lower lip portion 41 in the assembled position. The lip portions may be provided vertically between the wedge groove 23 and the front surface 15 and/or between the locking tongue 59, 60 and the front surface 15. The embodiment of FIG. 9 may generally correspond to the embodiment of FIGS. 2A-3C only without the upper and lower lip portions.

The embodiment of FIGS. 4A-5C may correspond in all aspects to the embodiment of FIGS. 2A-3C, however in this embodiment the intermediate surface 48 of the outer portion of the female protrusion Pf is smaller in length and thus the transition between the first impact surface 47 and the first outer surface 49 is shorter.

The mechanical locking device may comprise a first pair of cooperating horizontal locking surfaces and a second pair of horizontal locking surfaces, for horizontal locking of the first edge portion 11 and the second edge portion 12 in opposite horizontal direction, such as towards and away from each other in a direction transverse the edge portions. The first pair of horizontal locking surfaces may comprise one or more of the upper edge portions 42*a*, 42*b* of the first edge 11 being a first locking surface(s) of the first pair of horizontal locking surfaces and one or more of the upper edge portions 22*a*, 22*b* of the second edge 12 being a second locking surface(s) of the first pair of horizontal locking surfaces. The first upper edge portion 42*a* of the first edge 11 may be provided above the lower lip portion 41 and the first lower edge portion 42*b* may be provided below the lower lip portion 41. The second upper edge portion 22*a* of the second edge 12 may be provided above the upper lip portion 21 and the second lower edge portion 22*b* may be provided below the upper lip portion 21. The first pair of horizontal locking surfaces may extend in an essentially vertical V direction. As has been explained herein, the first pair of horizontal locking surfaces may in the second position be immediately juxtaposed a plane, such as a vertical plane.

An inner surface portion 45*b* of the locking element 45 of the female protrusion Pf may constitute a third horizontal locking surface and an outer surface portion 25*b* of the locking groove 25 of the male recess Rm may constitute a fourth horizontal locking surface. The third locking surface 45*b* and the fourth locking surface 25*b* makes a second pair of cooperating horizontal locking surfaces configured to cooperate, in the assembled position, for horizontal locking of the panels in a horizontal direction transverse the first edge 11 for parting away from each other. The second pair of locking surfaces 25*b*, 45*b* may in the second position during assembling be aligned such that a vertical displacement of the second edge 12 causes engagement between the second pair of locking surfaces. Thus, the guiding surfaces 46, 30 and/or impact surfaces 47, 29 are preferably configured such that when the impact surfaces 47, 29 are arranged parallel and in contact, for example at least partially immediately juxtaposed, the first pair of horizontal locking surfaces 22*a*, 42*a* and preferably the second pair of locking surfaces 45*b*, 25*b* are vertically aligned.

In one embodiment, in the assembled position, there may be provided a spaces s1, s2 extending from the second pair of horizontal locking surfaces 25*b*, 45*b* to the back surface 16 of the panels or at least to the intermediate surfaces 48, 28.

The displaceable tongue 60 may, during assembling, be displaced from a first projecting locking position to a retracted unlocking position by means of a lower edge portion 31*a*, 31*b* of the male protrusion Pm pushing the displaceable tongue 60 as a consequence of a vertical displacement of the second edge portion 12. The displaceable tongue, which may be a flexible and/or resilient tongue, may be configured to spring back from retracted position in a locking direction towards the projecting position by means of spring members.

The building panels 1, 2, 3 may be floorboards, wall panels, ceiling panels, a furniture component, or the like.

A core of each of the building panels 1, 2, 3 may be a wood-based core, such as comprising an HDF board, a particle board, or a plywood material.

A core of each of the building panels 1, 2, 3 may be a polymer-based core, such as comprising a thermoplastic material, and preferably a filler, or a thermosetting material. For example, the thermoplastic material may comprise PVC and the thermosetting material may comprise a melamine formaldehyde resin.

A core of each of the building panels 1, 2, 3 may be a mineral-based core, such as comprising magnesium oxide and, optionally, magnesium chloride, e.g., $MgCl_2$, and/or magnesium sulfate, e.g., $MgSO_4$.

The front face, such as the front surface 15, of the building panels 1, 2, 3 is preferably provided with a decorative layer and the back face, such as the back surface 16, is preferably provided with a balancing layer.

The thickness of the building panels 1, 2, 3 may be in the range of about 3 mm to about 16 mm, or in the range of about 4 mm to about 8 mm.

Items

ITEM 1. A set of building panels 1, such as floor panels, comprising a mechanical locking device at opposite first and second edge portions 11, 12, such as short edges, configured for horizontal H locking of similar or essentially identical panels in an assembled position by means of displacement in an engagement direction E, such as a vertical V direction, of the second edge portion 12 of a second panel 2 relative the first edge portion 11 of an adjacent first panel 1, wherein said second edge portion 12 comprises a locking groove 25 configured to receive a locking element 45 of the first edge portion 11 of an adjacent first panel 1 by means of said displacement. An outer portion 46-49 of said locking element 45, such as in a horizontal direction H transverse the first edge portion 11, may preferably be configured to cooperate with an inner portion 26-30 of said locking groove 25 for positioning, such as lateral L positioning, respective upper edge portions 22*a*, 42*a* of said first and second edge portions 11, 12 during assembling.

ITEM 2. The set according to item 1, wherein said outer portion of said locking element 45 and said inner portion of said locking groove 25 are configured to cooperate such that a displacement of the second edge 12 in the engagement direction E causes horizontal displacement of one or more of the upper edge portions 22*a*, 42*a*, such as the second upper edge portion 22*a*, preferably while being arranged on opposite sides of a horizontal plane.

ITEM 3. The set according to item 2, wherein said outer portion of said locking element 45 and said inner portion of said locking groove 25 are configured to cooperate such that and such that a further displacement in the engagement direction E, such as in an exclusively vertical direction, causes the upper edge portions 22*a*, 42*a* to become immediately juxtaposed.

ITEM 4. The set according to any one of the preceding items 1 to 3, wherein said respective upper edge portions 22*a*, 42*a* of said edge portions 11, 12 are, in the assembled position, immediately juxtaposed to form a vertical plane VP, wherein the first edge portion 11 comprises a locking strip 51 projecting beyond said vertical plane VP and wherein said locking strip comprises said locking element 45 for horizontal locking of said first and second panel 1, 2 from parting in a horizontal H direction transverse said edge portions.

ITEM 5. The set according to any one of the preceding items 1 to 4, wherein said positioning comprises an upper convex and/or protruding portion 46, 47 of said outer portion 46-49 of said locking element 45 engaging with a lower convex and/or protruding portion 29, 30 of said inner portion 26-30 of the locking groove 25.

ITEM 6. The set according to the preceding item 5, wherein said upper convex and/or protruding portion 46, 47 comprises a first guiding surface 46 and said lower convex and/or protruding portion 29, 30 comprises a second guiding surface 30 configured to cooperate with the first guiding surface 46 for said horizontal displacement of the second edge portion 12 in response to displacement of the second edge portion 12 in the engagement direction E.

ITEM 7. The set according to any one of the preceding items 4 to 6, wherein said upper convex and/or protruding portion 46, 47 comprises a first impact surface 47 and said lower convex and/or protruding portion 29, 30 comprises a second impact surface 29 configured to cooperate with the first impact surface 47 for horizontal positioning of the first and second edge portions 11, 12.

ITEM 8. The set according to item 7, wherein said guiding surfaces 46, 30 are configured to cause displacement of the second impact surface 29 in a direction towards the first impact surface 47, such as towards a plane of the first impact surface 47, in response to displacement of the second edge portion 12 in the engagement direction E, preferably said direction towards the first impact surface 47 comprises a horizontal H component and a vertical V component.

ITEM 9. The set according to any one of the preceding items 5 to 8, wherein said guiding surfaces 46, 30 are configured to cause displacement of a first upper edge portion 22*a* of the second edge portion 12 in a direction towards and/or into alignment with the plane of the first upper edge portion 42*a* of the first edge portion 11 in response to displacement of the second edge portion 12 in the engagement direction E, for said positioning of the respective upper edge surfaces 22*a*, 42*a*.

ITEM 10. The set according to any one of the preceding items 6 to 9, wherein a first distance d1 between the first upper edge portion 42*a* of the first edge 11 and the first impact surface 47 corresponds to a second distance d2 between the second upper edge portion 22*a* of the second edge 12 and the second impact surface 29.

ITEM 11. The set according to any one of the preceding items 1 to 1, wherein, during assembling, the second edge portion 12 is displaced laterally L from a first position to a second position, wherein said first position the first and second upper edge portions 42*a*, 22*a* are not abutting and are positioned on opposite sides of a horizontal H plane and/or a plane being parallel a front surface 15 of the first panel 1, and optionally positioned on opposite sides of a vertical V plane and/or a transverse plane; and wherein said second position the first and second upper edge portions 42*a*, 22*a* are arranged in a common vertical V plane or form a vertical V plane.

ITEM 12. The set according to any one of the preceding items 1 to 11, wherein the guiding surfaces 46, 30 are configured such that when the second edge 12 is displaced form the first position to second position, the guiding surfaces 46, 29 cooperate prior at least a portion of the first and second upper edge portions 42*a*, 22*a* are immediately juxtaposed and/or while first and second upper edge portion 42*a*, 22*a* are positioned on opposite sides of a horizontal H plane.

ITEM 13. The set according to item 12, wherein, during assembling, the second edge 12 is displaced in a vertical direction from the second position to a third position whilst the second impact surface 29 contacts the first impact surface 47, wherein the third position, preferably the impact surfaces 47, 29 are not in contact.

ITEM 14. The set according to any one of the preceding items 1 to 13, wherein the second upper edge portion 22*a* and optionally a second lower edge portion 22*b* are provided between second locking tongue 60 and/or above the wedge groove 23 and the front surface 15.

ITEM 15. The set according to any one of the preceding items 1 to 14, wherein the first upper edge portion 42*a* and optionally a first lower edge portion 42*b* are provided between the displacement groove 43 and the upper surface 15.

ITEM 16. The set according to any one of the preceding items 6 to 15, wherein the first and/or second impact surface 29, 47, in the assembled position, extend substantially in a vertical direction, such as parallel the vertical plane VP.

ITEM 17. The set according to any one of the preceding items 6 to 16, wherein the first and/or second impact surface 29, 47, in the assembled position, are parallel.

ITEM 18. The set according to any one of the preceding items 6 to 17, wherein the first impact surface 47 and the second impact surface 29 are, in the assembled position, aligned and/or arranged in a common vertical plane.

ITEM 19. The set according to any one of the preceding items 6 to 18, wherein the first impact surface 47 and a first inner surface 27 of the inner portion 26-30, such as an innermost surface, in the assembled position are horizontally separated by a first play p1.

ITEM 20. The set according to any one of the preceding items 6 to 19, wherein the second impact surface 29 and a first outer surface 49 of the outer portion 46-49 are, in the assembled position, horizontally separated by a second play p2.

ITEM 21. The set according to any one of the preceding items 1 to 2, wherein the locking element 45 comprises an upper surface 45*a*, preferably extending in an essentially horizontal direction, and wherein the outer portion 46-49, such as in a horizontal direction transverse the first edge portion 11, comprises an upper protruding portion 46-47 comprising a first guiding surface 46 being directly or indirectly contiguous with the upper surface 45*a*.

ITEM 22. The set according to the preceding item 21, wherein the first guiding surface 46 is inclined and/or sloping in a direction towards the plane of the back surface 16 of the panel, preferably the angle 46*a* of the slope is in the range of 40-55 degrees relative the plane of the back surface 16.

ITEM 23. The set according to any one of the preceding items 1 to 22, wherein the upper portion further comprises the first impact surface 47 contiguous with the first guiding surface 46, preferably the impact surface 47 extends in a substantially vertical V direction.

ITEM 24. The set according to any one of the preceding items 1 to 23, wherein the outer portion comprises an inwards recessing and/or concave lower portion 48-49 comprising the first outer surface 49 preferably extending in an essentially vertical direction towards the plane of the back surface 16.

ITEM 25. The set according to the preceding item 24, wherein an edge between the first outer surface 49 and the back surface 16 is chamfered to form a second outer surface 49.

ITEM 26. The set according to any one of the preceding items 24 to 25, wherein a first intermediate surface 48 extends between the upper portion 46-47 and the lower portion 49-49 of the outer portion 46-49, such as between the first impact surface 47 and the first outer surface 49.

ITEM 27. The set according to any one of the preceding items 1 to 25, wherein the locking groove 25 comprises an upper surface 25*a*, which may extend in an essentially horizontal direction, and wherein the inner portion 26-30, such as in a horizontal direction transverse the second edge portion 12, comprises a protruding and/or convex lower portion 29-30 comprising a second guiding surface 30, preferably contiguous with the back surface 16.

ITEM 28. The set according to any one of the preceding items 6 to 27, wherein the second guiding surface 30 is inclined in relation to the back surface 16 of the panel, preferably the angle 30*a* of the slope is in the range of 40-55 degrees relative the plane of the back surface 16.

ITEM 29. The set according to any one of the preceding items 5 to 28, wherein the lower portion 29-30 further comprises the second impact surface 29 directly or indirectly contiguous with the second guiding surface 30, preferably the second guiding surface 30 extends in a substantially vertical V direction.

ITEM 30. The set according to any one of the preceding items 5 to 29, wherein the outer portion comprises an inwards recessing and/or concave upper portion 26-27 comprising a first inner surface 27 preferably extending in an essentially vertical direction.

ITEM 31. The set according to the preceding item, wherein a corner between the first inner surface 27 and the upper surface of the locking groove 25*a* is chamfered to form a second inner surface 26, such as planar surface.

ITEM 32. The set according to any one of the preceding items 5 to 31, wherein a second intermediate surface 28 extends between the upper portion 26-27 and the lower portion 29-30 of the inner portion 26-30, such as between the second impact surface 29 and the first inner surface 27.

ITEM 33. The set according to any one of the preceding items 6 to 32, wherein the assembled position, the first guiding surface 46 is arranged opposite the second inner surface 26, i.e. facing the second inner surface 26.

ITEM 34. The set according to any one of the preceding items 7 to 33, wherein the assembled position, the first impact surface 47 is arranged opposite first inner surface 27 of the locking groove, wherein preferably the first inner surface 27 is an innermost surface of the locking groove 25, in a horizontal direction.

ITEM 35. The set according to any one of the preceding items 32 to 34, wherein the assembled position, the first intermediate surface 48 of the locking element 45 is arranged opposite the second intermediate surface 28 of the locking groove 25.

ITEM 36. The set according to any one of the preceding items 2 to 35, wherein the assembled position, the first outer surface 49 of the locking element 45 is arranged opposite the second impact surface 29 of the locking groove 25.

ITEM 37. The set according to any one of the preceding items 1 to 36, wherein the locking element 45 comprises an inner surface 45*a* contiguous with an upper surface 51*a* of the locking strip 51, wherein the slope of the inner surface 45*a* essentially corresponds to the slope of the first intermediate surface 48.

ITEM 38. The set according to any one of the preceding items 1 to 37, wherein the locking element 45 comprises an inner surface 45*a* forming a locking angle A contiguous with an upper surface 51*a* of the locking strip 51, wherein the slope of the inner surface 45*a* essentially corresponds to the slope of the second intermediate surface 28.

ITEM 39. The set according to any one of the preceding items 4 to 3, wherein the locking strip 51 comprises an upwards open groove 44 configured to receive a downwards extending protrusion 24 of the second edge 12 of an adjacent panel 2.

ITEM 40. The set according to any one of the preceding items 1 to 39, wherein the mechanical locking device comprises at one of the first or second edge portion 11, 12 a locking tongue 59 such as a displaceable locking tongue 60, configured to cooperate with a wedge groove 23 of the other of the first or second edge portion 11, 12 for vertical locking of the first and second edge portions in a plane.

ITEM 41. The set according to any one of the preceding items 1 to 3, wherein the panel comprises a lower lip portion 41 at the first edge portion 11 and an upper lip portion 21 at the second edge portion 12, said lip portions respectively comprising a planar and preferably substantially horizontal surface, said upper lip portion 21 preferably configured to bear on said lower lip portion 41 in the assembled position, wherein said lip portions are provided vertically between the wedge groove 23 and the front surface 15 and/or between the locking tongue 60 and the front surface 15.

The invention claimed is:

1. A set of building panels, wherein each building panel comprises:

a front surface and a back surface each extending between a first edge portion and an opposite second edge portion, and between a third edge portion and an opposite fourth edge portion, wherein the back surface is parallel to the front surface and is offset in a direction perpendicular to the front surface, wherein the panels have a lengthwise extension between the first edge portion and the opposite second edge portion, and a mechanical locking device arranged at the opposite first and second edge portions, configured for locking, in a direction parallel and/or perpendicular to the front surface, of similar or essentially identical building panels in an assembled position, by displacement in an engagement direction of the second edge portion of a second building panel relative the first edge portion of an adjacent first panel, wherein said mechanical locking device, at said second edge portion, comprises a locking groove configured to receive a locking element of the mechanical locking device arranged at said first edge portion of the adjacent first building panel, by said displacement, the locking groove having an inner portion and an outer portion which face one another, the inner portion of the locking groove being located between the outer portion of the locking groove and a center of the building panel, wherein an outer portion of said locking element is configured to cooperate with the inner portion of said locking groove, while the lengthwise extension of the first building panel remains essentially parallel to the lengthwise extension of the second building panel, for displacing an upper edge portion of said second edge portion of the second building panel in relation to an upper edge portion of said first edge portion of the adjacent first building panel during the displacement in the engagement direction of the second building panel during the assembling, and wherein said upper edge portion of said second edge portion of the second building panel and the upper edge portion of said first edge portion of the adjacent first building panel are configured to cooperate in an assembled position.

2. The set of building panels according to claim 1, wherein said outer portion of said locking element and said inner portion of said locking groove are configured to cooperate such that a displacement of the second edge of the second building panel in the engagement direction causes displacement of the upper edge portions of the second edge portion of the second building panel in the direction parallel to the upper surface away from the upper edge portion of the first edge portion of the adjacent first building panel.

3. The set of building panels according to claim 2, wherein said outer portion of said locking element and said inner portion of said locking groove are configured to cooperate such that the displacement in the engagement direction causes the upper edge portions of the first and second edge portions of the two adjacent building panels to become immediately juxtaposed after the displacement of the upper edge portions of the second edge portion of the second building panel in the direction parallel to the upper surface away from the upper edge portion of the first edge portion of the adjacent first building panel.

4. The set of building panels according to claim 2, wherein the displacement of the upper edge portion of the second edge of the second building panel in the direction parallel to the upper surface away from the upper edge portion of the first edge portion of the adjacent first building panel is achieved by a guiding surface of the locking groove at the second edge portion of the second building panel and a guiding surface of the locking element at the first edge portion of the adjacent first building panel when in contact with each other.

5. The set of building panels according to claim 1, wherein said upper edge portions of said first and second edge portions of the two adjacent building panels are, in the assembled position, juxtaposed to form a vertical plane, wherein the mechanical locking device at the first edge portion further comprises a locking strip projecting beyond said vertical plane and wherein said locking strip comprises said locking element for locking said first and second building panel in the direction parallel to the front surface, preventing the first and second building panel from parting in a direction parallel to the front surface, transverse said first and second edge portions.

6. The set of building panels according to claim 4, wherein said locking element further comprises an impact surface and wherein said locking groove further comprises an impact surface, wherein the respective impact surfaces are configured to, when in contact with each other, cooperate with each other for maintaining the displacement of the upper edge portion of the second edge of the second building panel in the direction parallel to the upper surface away from the upper edge portion of the first edge portion of the adjacent first building panel achieved by the guiding surfaces.

7. The set of building panels according to claim 6, wherein a first distance between the upper edge portion of the first edge portion and the impact surface of said locking element corresponds to a second distance between the upper edge portion of the second edge portion and the impact surface of said locking groove.

8. The set of building panels according to claim 1, wherein the second edge portion of the second building panel is displaced laterally, during assembling, from an initial position to an assembled position, wherein at said initial position the upper edge portions of the first and second edge portions are not abutting and are positioned on opposite sides of a plane being parallel to the front surface of the first building panel; and wherein at said assembling position the upper edge portions of the first and second edge portions are arranged in a common plane parallel to the front surface of the building panels.

9. The set of building panel according to claim 1, wherein the second edge portion of the second building panel is displaced laterally, during assembling, from an initial position to an assembled position, wherein at said initial position the upper edge portions of the first and second edge portions are not abutting and are positioned on opposite sides of a plane being perpendicular to the front surface of the first building panel; and wherein at said assembled position the upper edge portions of the first and second edge portions are arranged in a common plane perpendicular to the front surface of the building panels.

10. The set of building panels according to claim 4, wherein the guiding surfaces of the locking groove and the locking element are configured such that when the second edge portion of the second building panel is displaced from the initial position to the assembled position, the guiding surfaces cooperate with each other prior to when at least a portion of the upper edge portions of the first and second edge portion are juxtaposed and/or while the upper edge portion of the first and second edge portion are positioned on opposite sides of a plane parallel to the front surface of the first building panel.

11. The set of building panels according to claim 1, wherein the displacement of the upper edge portion of the second edge of the second building panel in the direction parallel to the upper surface towards the upper edge portion of the first edge portion of the adjacent first building panel is achieved by a locking surface of the locking groove at the second edge portion of the second building panel and a locking surface of the locking element at the first edge portion of the adjacent first building panel when in contact with each other.

12. The set of building panels according to claim 11, wherein the impact surfaces at respective edge portions are not cooperating with each other when the locking surfaces at respective edge portion are in contact with each other.

13. The set of building panels according to claim 11, wherein the locking surfaces at respective edges portion are sloped surfaces.

14. The set of building panels according to claim 11, wherein the outer portion of the locking element is configured to contact the inner portion of the locking groove for displacing the upper edge portion of the second edge portion of the second building panel in relation to the upper edge portion of the first edge portion of the adjacent first building panel during the displacement in the engagement direction of the second building panel during the assembling.

15. The set of building panels according to claim 11, wherein, in the assembled position, a part of the outer portion of the locking element is vertically above a part of the inner portion of the locking groove.

16. The set of building panels according to claim 1, wherein an outer portion of said locking element is configured to cooperate with the inner portion of said locking groove, while the front surface of the first building panel remains essentially parallel to the front surface of the second building panel, for displacing an upper edge portion of said second edge portion of the second building panel in relation to an upper edge portion of said first edge portion of the adjacent first building panel during the displacement in the engagement direction of the second building panel during the assembling.

* * * * *